US005682857A

United States Patent [19]

Briggs et al.

[11] Patent Number: 5,682,857

[45] Date of Patent: Nov. 4, 1997

[54] FUEL RAIL MOUNTING CLIP

[75] Inventors: Paul F. Briggs, Wolcott; George H. Bucci, South Windsor; David E. Mroczka, Cromwell; Allan L. Tomasco, Southington, all of Conn.

[73] Assignee: Walbro Corporation, Cass City, Mich.

[21] Appl. No.: 725,343

[22] Filed: Oct. 1, 1996

[51] Int. Cl.[6] ..... F02M 41/00

[52] U.S. Cl. ..... 123/456; 123/469; 411/368

[58] Field of Search ..... 123/456, 468, 123/469, 470, 472, 195 A; 411/147, 148, 154, 368

[56] References Cited

U.S. PATENT DOCUMENTS

| | | | |
|---|---|---|---|
| 532,078 | 6/1895 | Lorraine | 123/456 |
| 1,648,347 | 11/1927 | Hosking | 411/148 |
| 4,193,434 | 3/1980 | Wagner | 411/154 |
| 4,286,777 | 9/1981 | Brown | 248/635 |
| 4,306,708 | 12/1981 | Gassaway et al. | 248/635 |
| 4,428,331 | 1/1984 | Zang et al. | 123/184.38 |
| 4,435,112 | 3/1984 | Becker | 411/368 |
| 4,496,261 | 1/1985 | Cohen et al. | 411/368 |
| 4,520,987 | 6/1985 | Eguchi et al. | 248/635 |
| 4,586,477 | 5/1986 | Field et al. | 123/468 |
| 5,002,030 | 3/1991 | Mahnke | 123/468 |
| 5,044,338 | 9/1991 | Shelton | 123/469 |
| 5,074,269 | 12/1991 | Herbon et al. | 123/470 |
| 5,172,671 | 12/1992 | Peters et al. | 123/456 |
| 5,299,542 | 4/1994 | Hafner | 123/470 |
| 5,584,628 | 12/1996 | Bernoni | 411/368 |

*Primary Examiner*—Thomas N. Moulis

*Attorney, Agent, or Firm*—Barnes, Kisselle, Raisch, Choate, Whittemore & Hulbert

[57] ABSTRACT

A fuel rail is provided with a mounting clip in each mounting foot to allow secure connection of the fuel rail adjacent an engine manifold. The mounting clip is inserted into a mounting foot after the fuel rail has been manufactured and has a flange which overlies the top of the foot. The clip completely receives a bolt therein and when the bolt is tightened transmits a clamping force to the fuel rail through the flange of the clip. Thus, the bolt bears directly on the clip, not the fuel rail, and can be highly torqued without breaking the fuel rail.

10 Claims, 2 Drawing Sheets

FUEL RAIL MOUNTING CLIP

FIELD OF THE INVENTION

This invention relates to engine fuel rails and more particularly to a composite fuel rail.

BACKGROUND OF THE INVENTION

Fuel injected engines of motor vehicles typically use a fuel rail to supply fuel to the various fuel injectors which then deliver that fuel to the engine. Some fuel rails are being molded from plastics or other composite materials and are subject to breakage during assembly of the fuel rail and fuel injectors adjacent the engine. For instance, the fuel rail can break during assembly when the bolts which connect the fuel rail to the engine are over tightened putting high stresses on the fuel rail until it eventually cracks or breaks.

To prevent the fuel rails from breaking when assembled onto the engine, some fuel rails have been equipped with annular metallic inserts either integrally molded or heat staked to the mounting brackets of the fuel rail. The secure connection of these fuel rails to the engine depends on the quality of the connection between the metallic inserts and the mounting brackets of the fuel rail. Thus, a poor connection between the insert and the mounting bracket of the fuel rail results in a poor connection of the fuel rail to the engine. Further, these fuel rails require the additional step of providing an insert into the die molding for the fuel rail or of heat staking the insert to the rail after it has been formed. These additional steps add to the cost of manufacturing the fuel rail.

SUMMARY OF THE INVENTION

A composite fuel rail with a mounting clip for securely attaching the fuel rail to an engine manifold or other mounting location. The clip is constructed to be easily press-fit into a hole through a mounting foot of the fuel rail after the fuel rail has been manufactured.

The mounting clip has a generally cylindrical side wall, a generally radially extending and resilient flange adjacent the top of the side wall and preferably an annular bottom wall. The mounting clip also has an opening therethrough to receive the shank of a bolt with the head of the bolt bearing on the bottom wall of the clip. The flange is somewhat resilient and overlies and is canted to a portion of the top of the mounting foot.

During assembly of the fuel rail to the engine manifold the bolt is received in the engine manifold or other mounting location and tightened to secure the fuel rail in place. Upon tightening of the bolt, the mounting clip is pulled further through the hole in the mounting foot of the fuel rail, flexing the flange of the mounting clip. The flexed flange exerts a force on the fuel rail which clamps the fuel rail in place against the engine manifold. The bottom wall of the mounting clip is secured between the head of the bolt and the engine manifold. Thus, because the material of the fuel rail itself does not directly receive the loading of the bolt, the mounting clip allows the bolt to be highly torqued or tightened without breaking the fuel rail. Further, the interface between the bolt head, bottom wall and engine manifold is a metal-to-metal interface which allows substantial tightening of the bolt without breaking the clip or fuel rail to ensure a secure connection between the fuel rail and the engine manifold.

Objects, features and advantages of this invention are to provide a composite fuel rail that prevents breakage of the mounting foot due to over tightening of the bolt when the fuel rail is connected to an engine manifold, provides a metal-to-metal interface at the point of connection between the fuel rail and the engine manifold enabling the bolt to be highly tightened to provide a secure connection between the fuel rail and the manifold, has a mounting clip press-fit into the mounting foot of the fuel rail after it has been molded, eliminates molded mounting inserts, maintains a uniform load on the mounting foot, limits the maximum load on the mounting foot, provides vibration dampening from the manifold to the fuel rail due to the flexible mounting connection between the clip and the fuel rail, is simple, stable, rugged, durable, reliable, quick and easy to assemble, and of relatively simple design and economical manufacture and assembly.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENT

Figure 1:
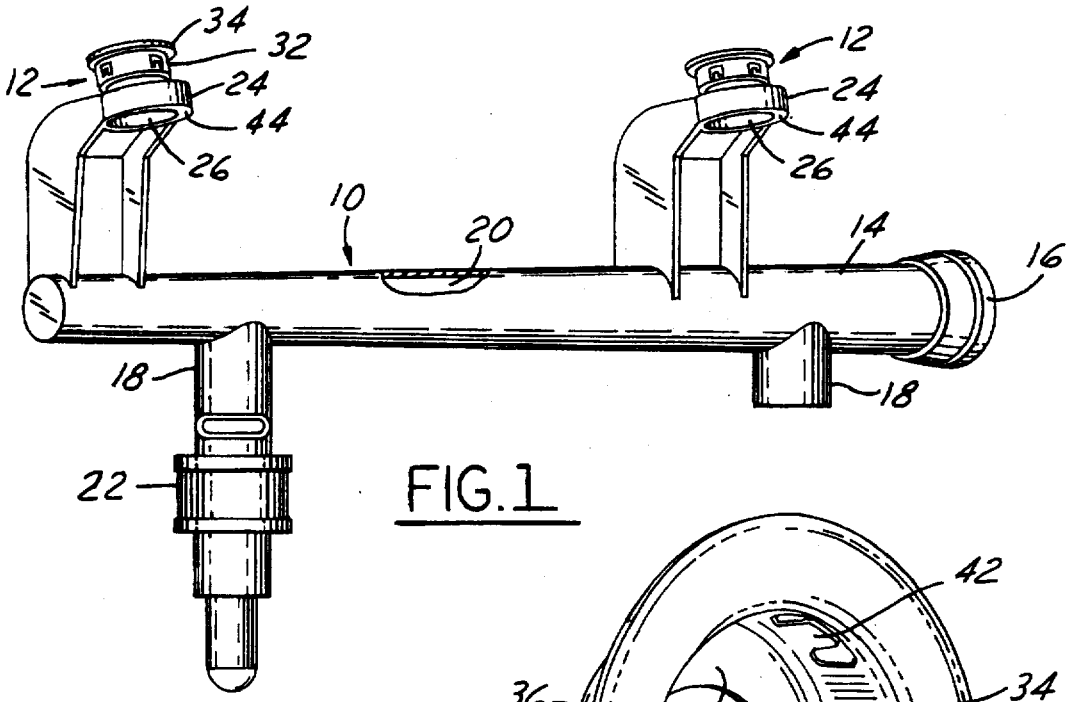
FIG. 1 is a perspective view of a fuel rail embodying this invention.

Referring in more detail to the drawings, FIG. 1 illustrates a composite fuel rail 10 with a mounting clip 12 embodying this invention, The fuel rail 10 has a body 14 with an inlet 16 and several outlets 18 each communicating with a central passage 20 within the body. Each outlet 18 is constructed to communicate with a fuel injector 22 to deliver fuel to each of the fuel injectors 22 of an engine of a motor vehicle. Preferably, a pair of mounting feet 24 extend from the fuel rail 10 and each have a through hole 26 constructed to receive a clip 12 which receives a bolt to mount to the fuel rail 10 on an engine manifold or other such mounting surface. Preferably the fuel rail 10 is injection molded in one piece of a plastic material of suitable strength and heat and fuel resistance such as PPS which is commercially available from Hoechst Celanese under the trade name Fortron.

Figure 2:
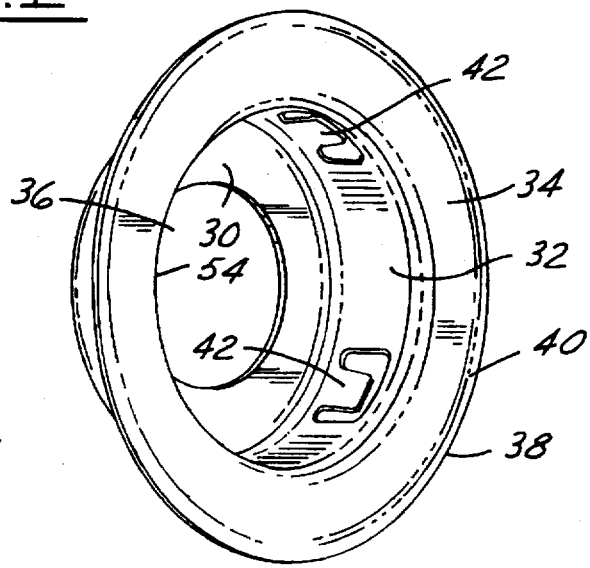
FIG. 2 is an enlarged perspective view of a mounting clip of the fuel rail of FIG. 1.

The mounting clip 12 is preferably made of metal and, as shown in FIG. 2, has a bottom wall 30, a generally cylindrical side wall 32 extending from the bottom wall 30, and a radially extending and resilient flange 34 adjacent the top of the side wall 32. An opening 36 is provided through the clip 12 to receive the shank of a bolt inserted into the clip 12 so that the head of the bolt is received in the clip 12 and contacts the bottom wall 30.

As shown in FIGS. 3–6, the flange 34 is preferably inclined at an acute included angle relative to the axis of the mounting clip 12 and the face of the foot 24 so that, when fitted into the mounting foot 24, the flange 34 contacts the mounting foot 24 adjacent the outer edge 38 of the flange 34 and can flex against the foot 24 when the fuel rail 10 is mounted adjacent the engine. Also preferably, to reduce the frictional engagement between the flange 34 and the mounting foot 24 to prevent the sharp edge of the periphery of the flange 34 from digging into the foot 34, a return bend 40 is provided about the outer edge 38 of the flange 34 providing a smooth contact surface between the mounting clip 12 and the mounting foot 24. Also preferably, to provide an interference fit between the clip 12 and the mounting foot 24, the side wall 32 is formed with a plurality of projections or tabs 42 extending outwardly therefrom which provide an effective outside diameter of the mounting clip 12 that is slightly greater than the inside diameter of the through hole 26 of the mounting foot 24. Preferably, four projections 42 are provided evenly spaced circumferentially about the side wall 32. This permits the clips 12 to be inserted into the fuel rail 10 after the rail 10 is molded, retains the clips 12 therein during shipping and handling of the rail 10, and facilitates assembly of the fuel rail 10 to the engine manifold 52. Further, with the interference fit adjacent the tabs only and not the entire side wall 32, there is generally little stress on the foot and the through hole 26 can be formed with higher dimensional tolerance.

Preferably, the bottom wall 30 of the mounting clip 12 is inclined at an acute included angle relative to the axis of the clip 12 and the mounting surface to slope upwardly and inwardly. Also preferably, to inhibit the clip 12 from sliding down or off the shank of a bolt before the fuel rail is mounted to the engine manifold, the surface of the bottom wall 30 adjacent the opening 36 is sharp to provide increased friction between the clip 12 and the bolt. Thus, the clip 12 and bolt 50 can be inserted as a unit into the mounting foot 24 after the rail 10 is molded to facilitate assembly of the rail 10 to the manifold.

Figure 3:
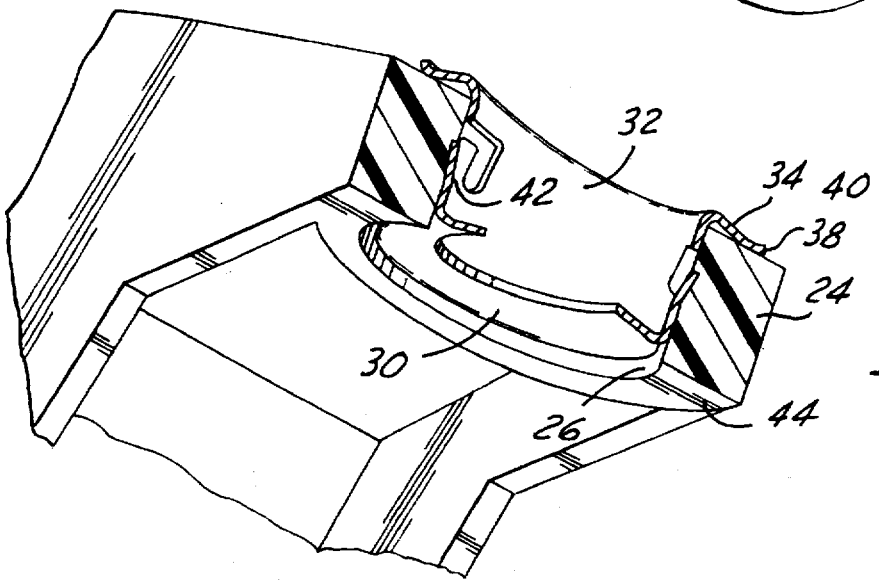
FIG. 3 is a sectional view showing a mounting clip inserted into a mounting foot of the fuel rail.
Figure 4:
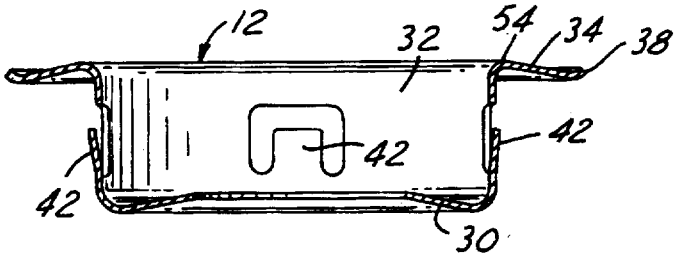
FIG. 4 is a cross sectional view of a mounting clip.
Figure 5:
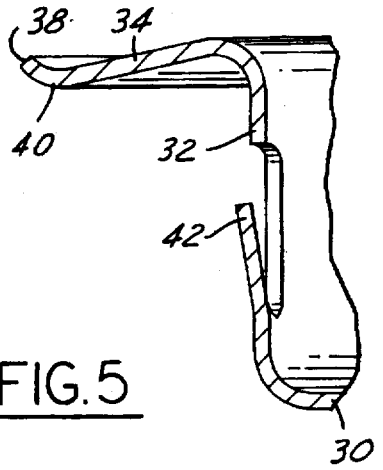
FIG. 5 is an enlarged, fragmentary, sectional view illustrating the construction of the side wall and flange of the mounting clip.
Figure 6:
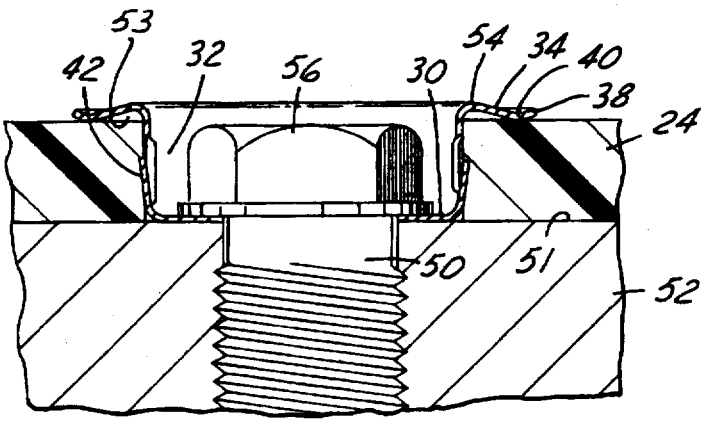
FIG. 6 is a sectional view illustrating the fuel rail and mounting clip secured to an engine manifold by a bolt.

In an unloaded condition, as shown in FIG. 3, the surface 40 of the flange 34 contacts the mounting foot 24 before the bottom wall 30 of the clip 12 reaches the lower edge 44 of the mounting foot 24. As shown in FIG. 6, when the bolt 50 is tightened down to securely mount the fuel rail 10 on the surface 51 of the engine manifold 52, the mounting clip 12 is pulled down further into the through hole 26 of the mounting foot 24 until the bottom wall 30 of the mounting clip 12 is substantially level with the lower edge 44 of the mounting foot 24 and bears on the surface 51 of the engine manifold 52. This tends to flex the flange 34 which is in contact with the top of the mounting foot 24. The resilient flange 34 resists flexing which provides a force acting on the mounting foot 24 which firmly clamps and holds the mounting foot 24 on the surface 51 of the engine manifold 52.

To prevent excessive forces on the mounting foot 24 or deformation of the clip 12 during assembly, the thickness of the side wall 32 of the clip 12 is preferably at least as great as the thickness of the mounting foot 24 adjacent the through hole 26, and more preferably, the thickness of the side wall 32 is greater than the thickness of the mounting foot 24 so that a gap 53 remains between the inner edge 54 of the flange 34 and the top of the mounting foot 24. This allows the flange 34 to flex slightly during use and tends to dampen the vibrations felt by the fuel rail 10. The flexible connection between the clip 12 and rail 10 can also reduce the stress on the mounting foot 24 caused by jostling or bumping of the fuel rail 10 during assembly and use and thereby reduce fuel rail 10 breakage under such conditions.

When tightened, the force of the bolt 50 flattens the bottom wall 30 of the mounting clip 12 against the surface 51 of the engine manifold 52 and thereby further deflects the flange 34 providing an increased clamping force holding the fuel rail 10 on the engine manifold 52. In addition, the resistance of the bottom wall 30 to bending provides a reactive force acting on the head 56 of the bolt which tends to prevent counter rotation and loosening of the bolt.

In use, the force which clamps the fuel rail 10 to the engine manifold 52 is produced by flexing of the flange 34 of the mounting clip 12 and not directly by the bolt 50. Also, the mounting clip 12 provides a metal-to-metal interface between the bolt 50 and the engine manifold 52 enabling the bolt 50 to be highly torqued without breaking the fuel rail 10. Further, by controlling the axial height of the side wall 32 of the clip 12 the maximum force on the foot 24 produced by the flexed flange 34 can be controlled and limited to less than the compressive strength of the foot 24 to prevent damage to the foot 24. Thus, the load bearing and load producing characteristics of the mounting clip 12 ensure a consistent and secure connection between the fuel rail 10 and the engine manifold 52.

We claim:

1. A fuel rail for an engine having a fuel injector comprising:

a body;

a passage in the body for distributing fuel to at least one fuel injector;

a mounting foot carried by the body;

a circular through hole in the mounting foot;

a mounting clip constructed to be at least partially received in the through hole of the foot and having;

an annular, radially extending flange adjacent one end of the clip constructed to engage the mounting foot and when unflexed is inclined at an acute included angle relative to the axis of the flange;

an annular side wall of the clip adjacent the flange;

an annular bottom wall adjacent the end of the side wall opposite the flange constructed to be received between the head of a bolt and an engine manifold; and a hole through the clip and constructed to receive the shank of a bolt whereby the clip is press-fit into the through hole of the mounting foot with the flange overlying a portion of the mounting foot and the side wall of the clip extending into the through hole of the mounting foot, the mounting clip slidably receives a bolt therethough such that the head of the bolt bears on the bottom wall and the flange exerts a force on the mounting foot to secure the fuel rail adjacent the engine.

2. The fuel rail of claim 1 wherein the bottom wall is inclined inwardly and upwardly at an acute included angle relative to the axis of the side wall so that bottom wall is deflected or flattened by the head of the bolt as the bolt is tightened and thereby exerts a reactive force on the bolt to ensure a secure connection of the fuel rail adjacent the engine.

3. The fuel rail of claim 1 wherein the height of the side wall of the clip is greater than the thickness of the mounting foot and, in assembly, the outer edge of the flange contacts the mounting foot limiting the insertion of the clip into the mounting foot.

4. The fuel rail of claim 3 wherein the flange is inclined at an angle such that the periphery of the flange contacts the mounting foot when the bottom wall is interior of the opening of the mounting foot.

5. The fuel rail of claim 1 wherein the side wall has at least one projection which extends outwardly from the side wall providing an interference fit between the projection and the mounting foot when the clip is fitted into the through hole of the mounting foot.

6. The fuel rail of claim 5 wherein said at least one projection is at least one outwardly protruding tab formed in the side wall.

7. The fuel rail of claim 6 wherein said at least one tab comprises four tabs generally evenly spaced about the side wall.

8. The fuel rail of claim 5 wherein said at least one projection is an at least partially annular rib formed in the side wall.

9. The fuel rail of claim 1 wherein the flange has a return bend adjacent its periphery providing a smooth contact surface between the mounting clip and the mounting foot.

10. A mounting clip for a fuel rail having a body, a passage in the body for distrubuting fuel to at least one fuel injector, a mounting foot carried by the body and a circular through hole in the mounting foot, the mounting clip comprising:

an annular, radially extending flange adjacent one end of the clip constructed to engage the mounting foot and when unflexed is inclined at an acute included angle relative to the axis of the flange;

an annular side wall of the clip adjacent the flange;

an annular bottom wall adjacent the end of the side wall opposite the flange constructed to be received between the head of a bolt and an engine manifold; and a hole through the clip and constructed to receive the shank of a bolt whereby the clip is press-fit into the through hole of the mounting foot with the flange overlying a portion of the mounting foot and the side wall of the clip extending into the through hole of the mounting foot, the mounting clip slidably receives a bolt therethough such that the head of the bolt bears on the bottom wall and the flange exerts a force on the mounting foot to secure the fuel rail adjacent the engine.

* * * * *